US011088492B2

(12) United States Patent
Kobayashi et al.

(10) Patent No.: US 11,088,492 B2
(45) Date of Patent: Aug. 10, 2021

(54) LEVER-TYPE CONNECTOR AND METHOD OF ASSEMBLING LEVER-TYPE CONNECTOR

(71) Applicant: Yazaki Corporation, Tokyo (JP)

(72) Inventors: Tooru Kobayashi, Shizuoka (JP); Motoyoshi Suzuki, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/877,583

(22) Filed: May 19, 2020

(65) Prior Publication Data

US 2020/0381862 A1 Dec. 3, 2020

(30) Foreign Application Priority Data

May 27, 2019 (JP) ..... JP2019-098232

(51) Int. Cl.
*H01R 13/629* (2006.01)
*H01R 13/502* (2006.01)

(52) U.S. Cl.
CPC ..... *H01R 13/62938* (2013.01); *H01R 13/502* (2013.01)

(58) Field of Classification Search
CPC ..... H01R 13/502; H01R 13/62938
USPC ..... 439/370
See application file for complete search history.

(56) References Cited

U.S. PATENT DOCUMENTS 5,463,912 A * 11/1995 Inoue ..... H01R 13/62938 403/321
5,876,225 A * 3/1999 Katsuma ..... H01R 13/6295 439/157
5,888,081 A * 3/1999 Konoya ..... H01R 13/62955 439/157
5,938,458 A * 8/1999 Krehbiel ..... H01R 13/62938 439/157
5,975,928 A * 11/1999 Tsuji ..... H01R 13/62938 439/157
6,193,531 B1 * 2/2001 Ito ..... H01R 13/62933 439/157
6,213,795 B1 * 4/2001 Drescher ..... H01R 13/62977 439/152
6,217,354 B1 * 4/2001 Fencl ..... H01R 13/62977 439/157
6,832,922 B2 * 12/2004 Kozono ..... H01R 13/447 439/135
7,267,564 B2 * 9/2007 Bauman ..... H01R 13/62955 439/157
7,695,297 B2 * 4/2010 Pittenger ..... H01R 13/62933 439/157

(Continued)

FOREIGN PATENT DOCUMENTS

JP 2013-062078 A 4/2013

*Primary Examiner* — Peter G Leigh
(74) *Attorney, Agent, or Firm* — Sughrue Mion, PLLC

(57) ABSTRACT

A lever-type connector includes a first housing having a cam boss and a second housing fitted and detached from the first housing. A lever is rotatably supported to the second housing via lever bosses, and both housings and are fitted by rotating an operating portion. A cable cover is attached to a rear portion of the second housing to protect a plurality of cables drawn from the rear portion of the second housing. The second housing has an assembling portion for assembling the cable cover, and boss holes for rotatably supporting the lever bosses.

5 Claims, 14 Drawing Sheets

(56) References Cited

U.S. PATENT DOCUMENTS

| | | | | |
|---|---|---|---|---|
| 8,057,245 | B2 * | 11/2011 | Sakamaki | H01R 13/62933 439/157 |
| 8,197,271 | B2 * | 6/2012 | Kobayashi | H01R 13/62955 439/157 |
| 8,235,742 | B2 * | 8/2012 | Komiyama | H01R 13/62977 439/347 |
| 9,022,793 | B2 * | 5/2015 | Kobayashi | H01R 13/5213 439/157 |
| 9,608,357 | B1 * | 3/2017 | Sundarakrishnamachari | H01R 13/4534 |
| 2003/0003786 | A1 * | 1/2003 | Bakker | H01R 13/4538 439/157 |
| 2004/0192090 | A1 * | 9/2004 | Flowers | H01R 13/5812 439/157 |
| 2006/0089031 | A1 * | 4/2006 | Flowers | H01R 13/639 439/157 |

* cited by examiner

LEVER-TYPE CONNECTOR AND METHOD OF ASSEMBLING LEVER-TYPE CONNECTOR

BACKGROUND

Technical Field

The present disclosure relates to a lever-type connector in which both male and female housings are fitted and detached with a low insertion force by operating a lever, and a method of assembling the lever-type connector.

Related Art

A conventional lever-type connector is described in JP 2013-62078 A. This lever-type connector includes a mating male housing, a female housing fitted and detached with the male housing, a lever which is rotatably supported to the female housing via a lever support boss portion, and fits the female housing into the male housing with a low insertion force by rotating an operating portion, and a cover attached to a rear end of the female housing. Note that the female housing is provided with a plurality of terminal accommodating chambers for accommodating terminals to which cables are connected.

Then, the procedure for assembling the lever-type connector is as follows. First, terminals to which cables are connected are inserted into terminal accommodating chambers from the rear of the female housing. Next, the lever is assembled from the rear of the female housing. Finally, the cover is assembled to the rear end of the female housing.

SUMMARY

However, since the lever is previously assembled to the female housing in the conventional lever-type connector described above, it is difficult to attach the cover when assembling the cover to the rear end of the female housing.

The present disclosure has been made to solve the problem described above, and aims to provide a lever-type connector and a method of assembling the lever-type connector, which can improve the work of inserting terminals and the ease of assembling a cover.

The present disclosure provides a lever-type connector, including: a first housing having a cam boss; a second housing fitted to and detached from the first housing; a lever that is rotatably supported to the second housing via a lever boss and has a cam groove engaged with the cam boss, wherein the lever pulls the first housing toward the second housing and fits the first housing to the second housing with an engagement between the cam groove and the cam boss by rotating an operating portion; and a cable cover attached to a rear portion of the second housing and protecting a plurality of cables drawn out from the rear portion of the second housing, wherein the second housing has an assembling portion for assembling the cable cover, and boss holes rotatably supporting the lever bosses.

In addition, the present disclosure provides a method of assembling a lever-type connector, the lever-type connector including: a first housing having a cam boss; a second housing that has terminal accommodating chambers in which a plurality of terminals to which cables are connected are accommodated and that is fitted to and detached from the first housing; a lever that is rotatably supported to the second housing via lever bosses and has a cam groove engaged with the cam boss, wherein the lever pulls the first housing toward the second housing and fits the first housing to the second housing with an engagement between the cam groove and the cam boss by rotating an operating portion; and a cable cover attached to a rear portion of the second housing and protecting a plurality of the cables drawn out from the rear portion of the second housing, the method, including following steps in stated order of: a terminal inserting step of inserting terminals into the terminal accommodating chambers of the second housing; a cover assembling step of assembling the cable cover to the second housing in which the terminals are inserted into the terminal accommodating chambers; and a lever assembling step of fitting the lever bosses into the boss holes of the second housing and assembling the lever to the second housing.

According to the present disclosure, by assembling the lever to the housing last, the work of inserting the terminal and the ease of assembling the cover can be improved, and the work efficiency can be improved.

DETAILED DESCRIPTION

Hereinafter, embodiments of the present disclosure will be described with reference to the drawings.

Figure 1:
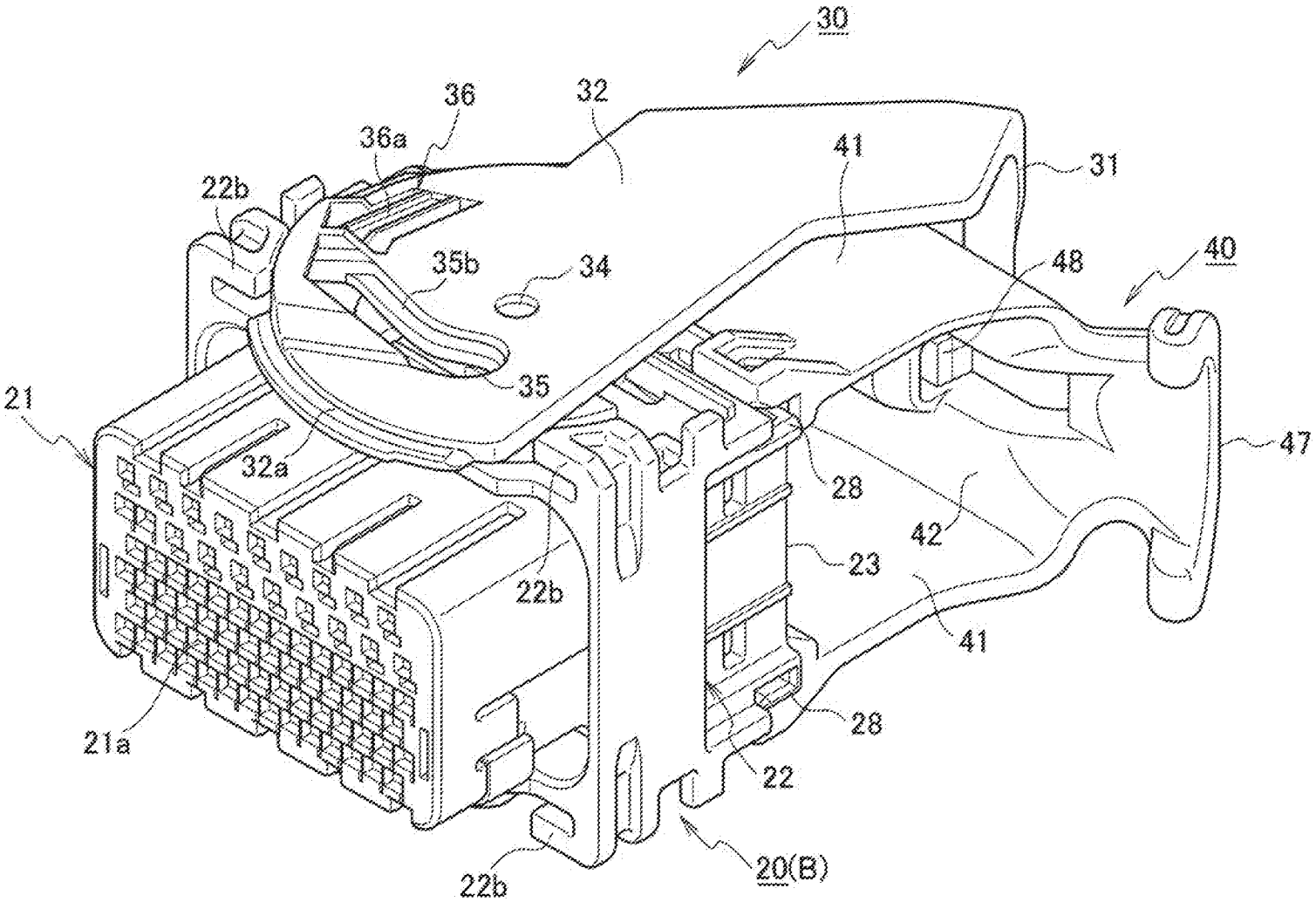
FIG. 1 is a perspective view illustrating a state where a cable cover and a lever are assembled to a female housing of a lever-type connector according to a first embodiment of the present disclosure.
Figure 2:
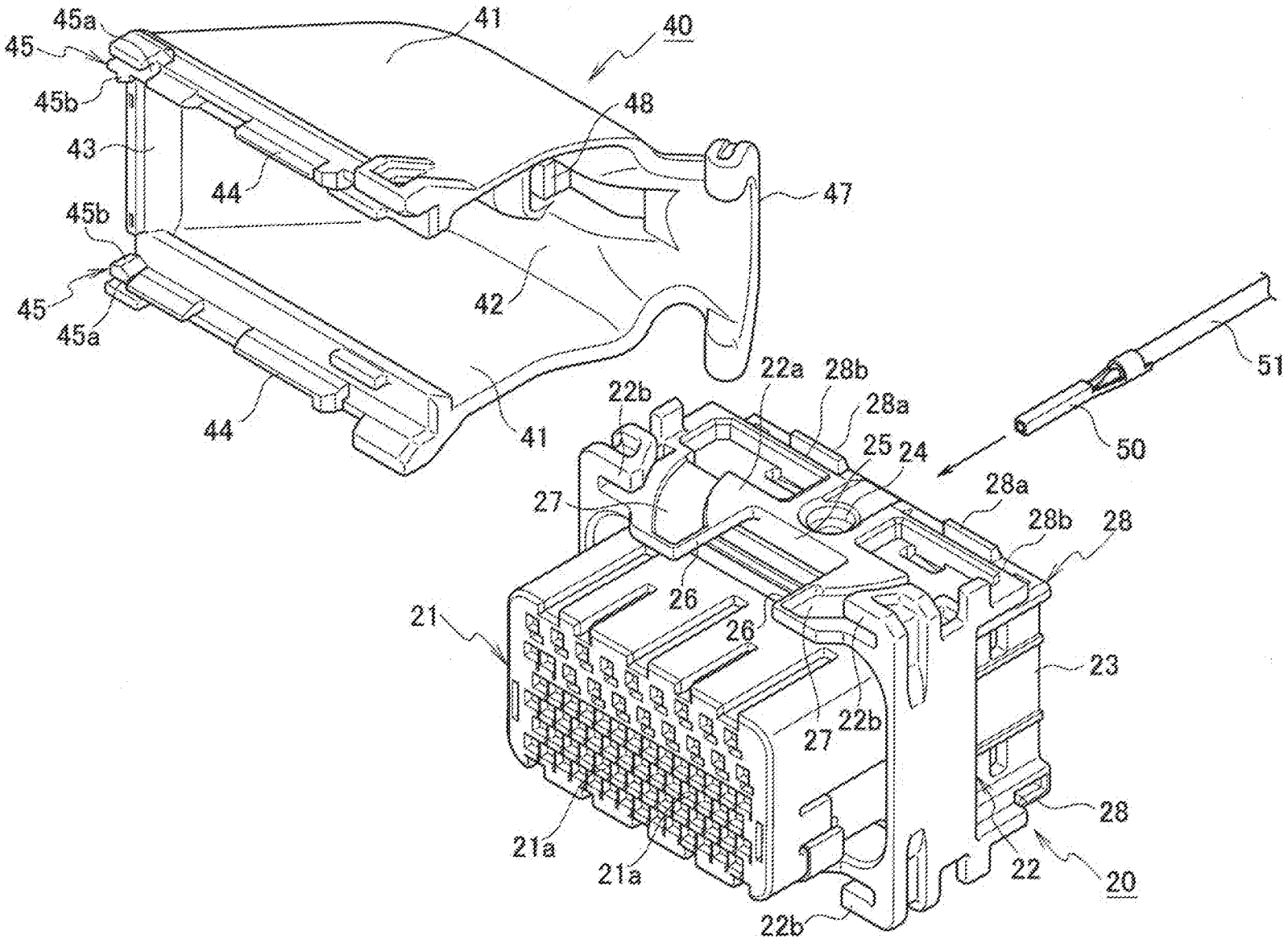
FIG. 2 is a perspective view illustrating a state before a cable cover is assembled to the female housing.
Figure 3:
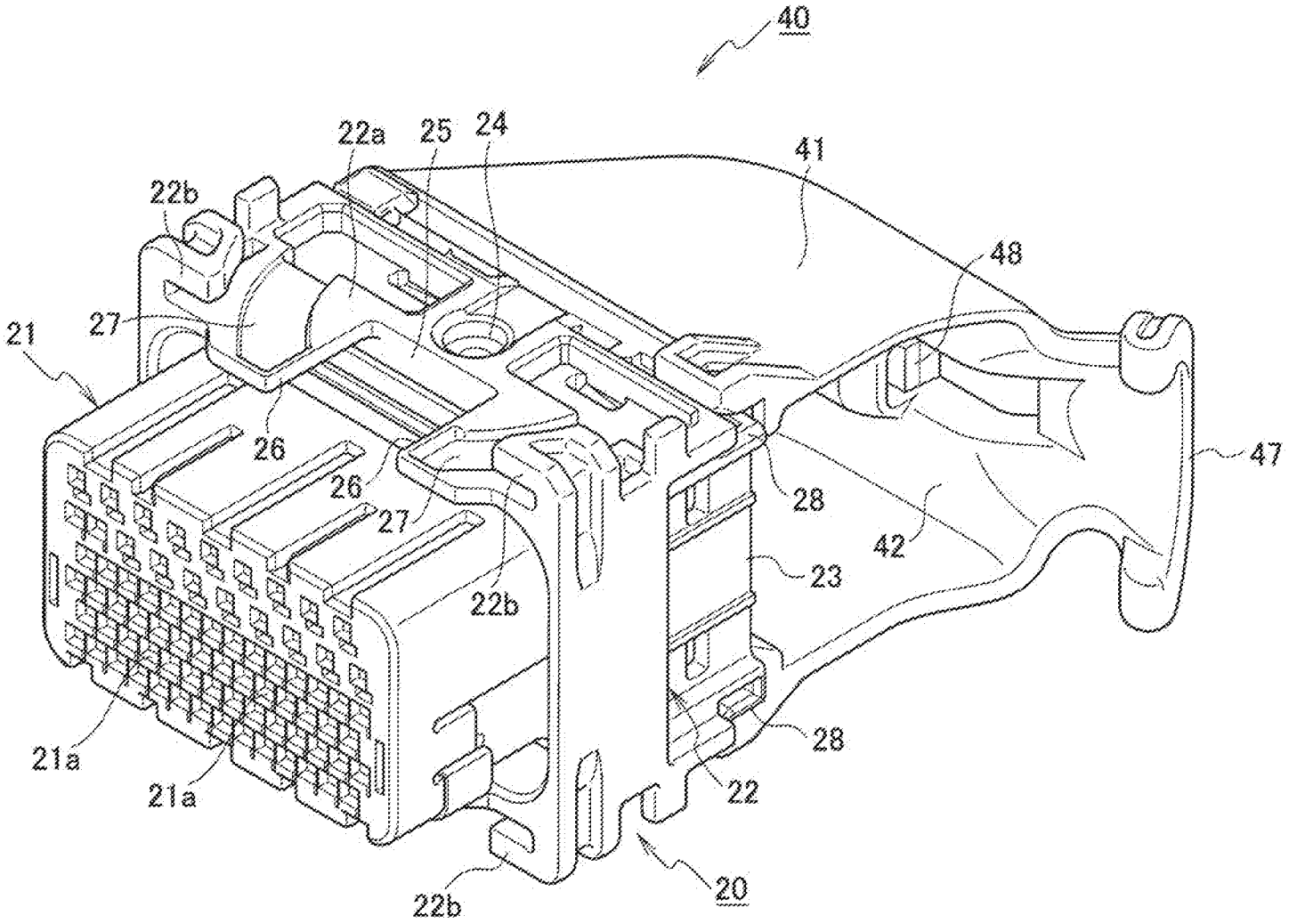
FIG. 3 is a perspective view illustrating a state where a cable cover is assembled to the female housing.
Figure 4:
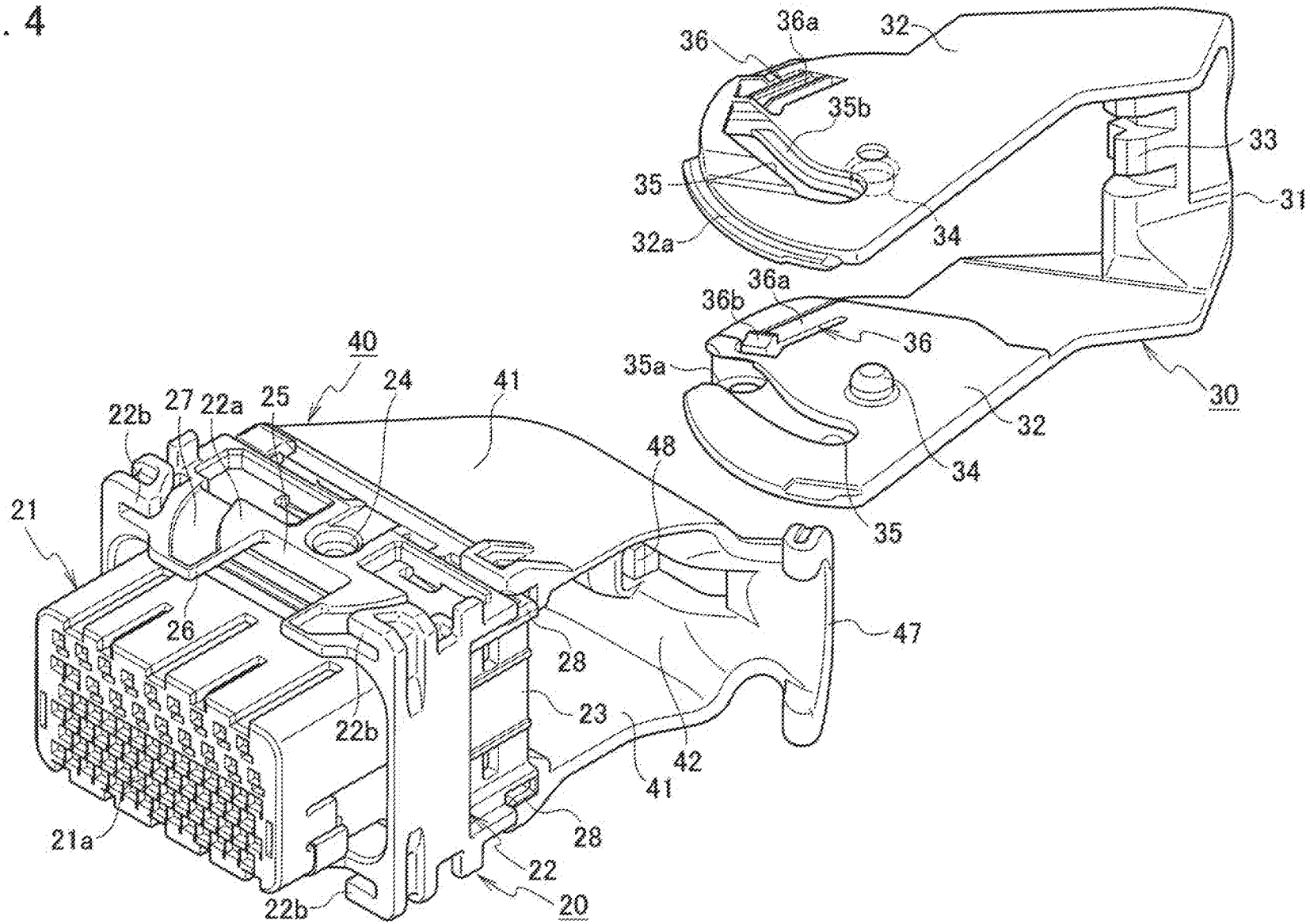
FIG. 4 is a perspective view illustrating a state before a lever is assembled to the female housing.
Figure 5:
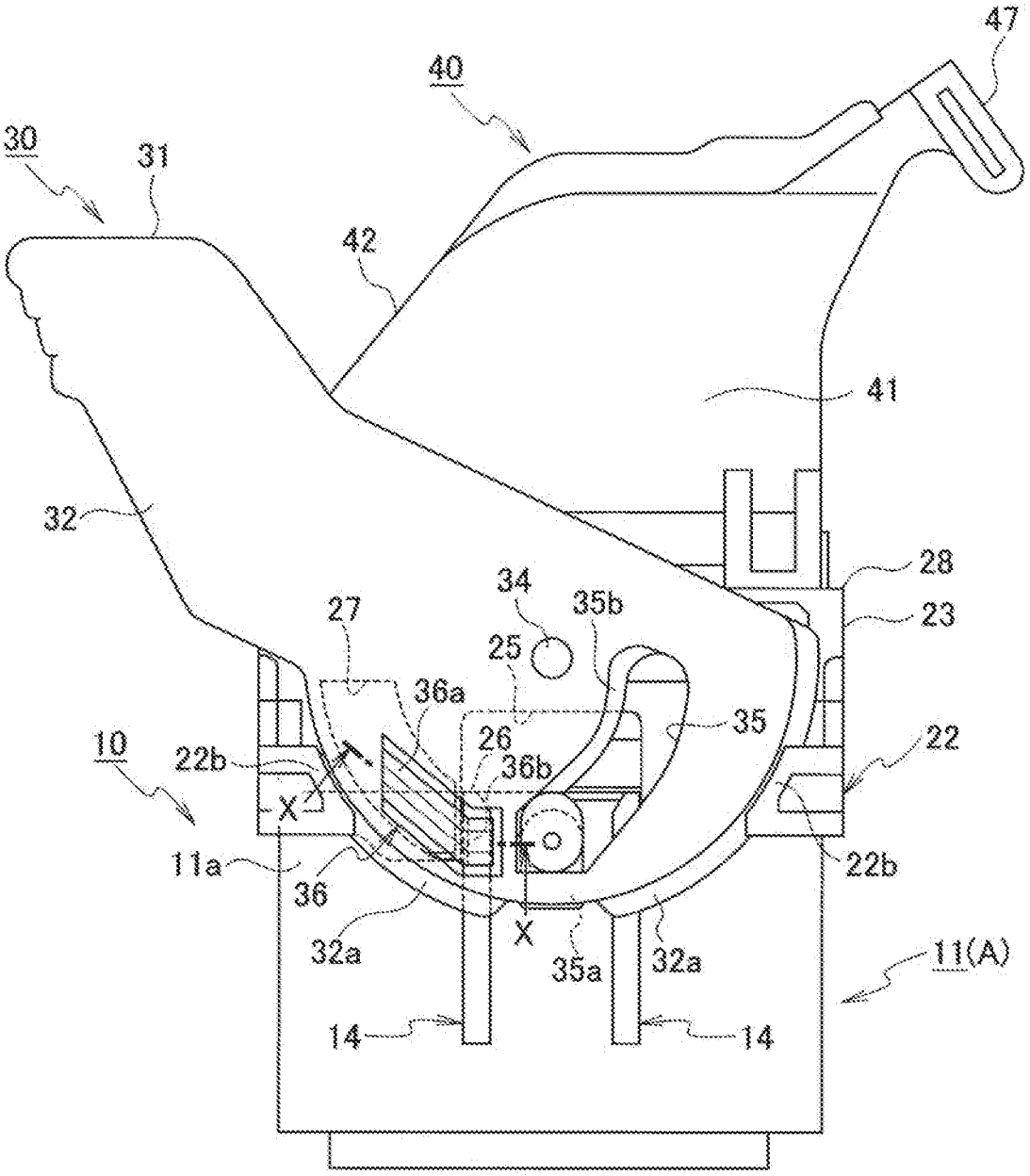
FIG. 5 is a side view illustrating a state before fitting of the lever-type connector.
Figure 6:
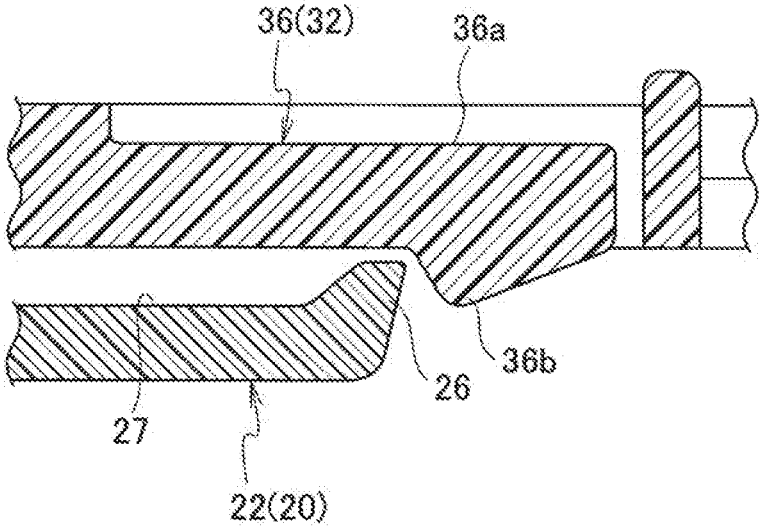
FIG. 6 is a cross-sectional view taken along line X-X in FIG. 5.
Figure 7:
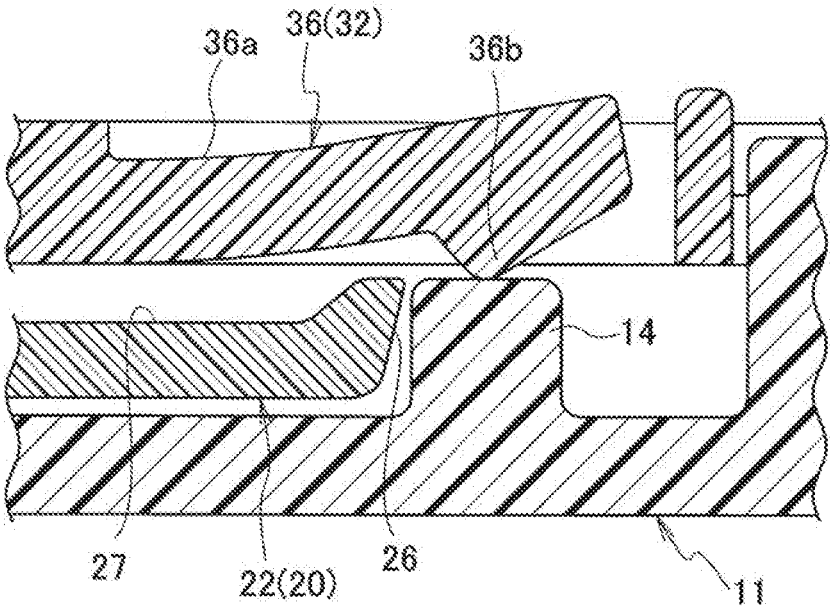
FIG. 7 is a cross-sectional view corresponding to a cross-sectional view taken along line X-X in FIG. 5 in a state where the temporary locking lock portion of the lever is released.
Figure 8:
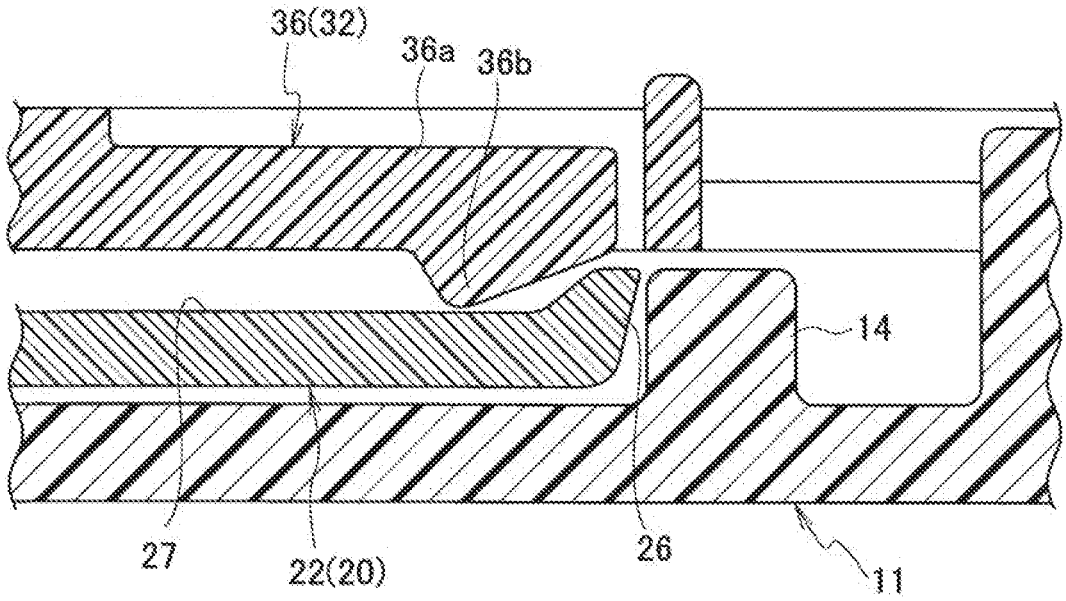
FIG. 8 is a cross-sectional view corresponding to a cross-sectional view along line X-X in FIG. 5 in a state where the temporary locking lock portion of the lever is dropped into a lock storage portion of the female housing.

FIG. 1 is a perspective view illustrating a state where a cable cover and a lever are assembled to a female housing of a lever-type connector according to a first embodiment of the present disclosure; FIG. 2 is a perspective view illustrating a state before a cable cover is assembled to the female housing; FIG. 3 is a perspective view illustrating a state where a cable cover is assembled to the female housing; FIG. 4 is a perspective view illustrating a state before a lever is assembled to the female housing; FIG. 5 is a side view illustrating a state before fitting of the lever-type connector; FIG. 6 is a cross-sectional view taken along line X-X in FIG. 5; FIG. 7 is a cross-sectional view corresponding to a cross-sectional view taken along line X-X in FIG. 5 in a state where the temporary locking lock of the lever is released; FIG. 8 is a cross-sectional view corresponding to a cross-sectional view along line X-X in FIG. 5 in a state where the temporary locking lock portion of the lever is dropped into a lock storage portion of the female housing; and FIG. 9 is a side view illustrating a fitted state of the lever-type connector.

Figure 9:
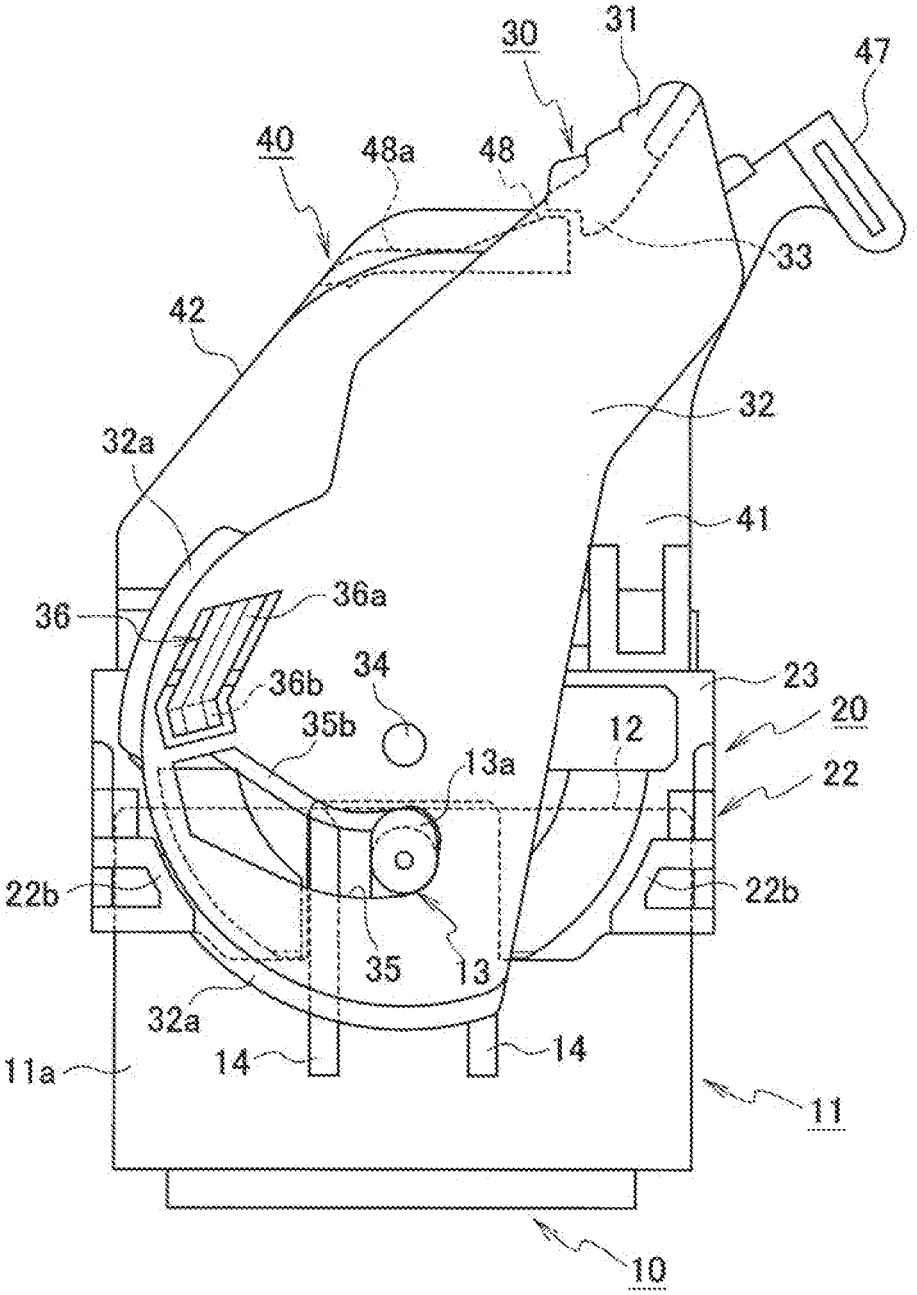
FIG. 9 is a side view illustrating a fitted state of the lever-type connector.

As illustrated in FIGS. 5 and 9, the lever-type connector 10 includes a male housing (first housing) 11 made of a synthetic resin having a cam boss 13; a female housing (second housing) 20 fitted to and detached from the male housing 11 and made of a synthetic resin; a synthetic resin lever 30 that is rotatably supported in a boss hole 24 provided in the female housing 20 via lever bosses 34 and has a cam groove 35 engaged with the cam boss 13, wherein the lever 30 pulls the male housing 11 toward the female housing 20 and fits both male and female housings 11, 20 with an engagement between the cam groove 35 and the cam boss 13 by rotating an operating portion 31; and a cable cover 40 made of a synthetic resin that is attached to an assembling portion 28 in a rear portion of the female housing 20 and protects a plurality of cables 51 drawn out from the rear portion of the female housing 20.

As illustrated in FIG. 5, the male housing 11 has a hood portion 12 inserted into the outer jacket portion 22 of the female housing 20 on the front side. In addition, a columnar cam boss 13 is protruded and formed integrally in the center of the front side of both side surfaces 11*a*, 11*a* of the male housing 11, respectively. Furthermore, on both side surfaces 11*a*, 11*a* of the male housing 11, a pair of lever temporary locking release ribs 14, 14 are protruded and formed integrally so as to sandwich the cam boss 13. The tip 14*a* side of each lever temporary locking release rib 14 is a release portion for releasing the temporarily locked state between a temporary locking lock portion 36 of a pair of arm portions 32, 32 of the lever 30 and a pair of temporary locking portions 26, 26 of the female housing 20, which will be described later. Note that a tab portion of a male terminal (terminal) (not illustrated) is exposed in the hood portion 12 of the male housing 11.

As illustrated in FIGS. 2 to 4, the female housing 20 includes a block-shaped housing main body 21 having a plurality of terminal accommodating chambers 21*a* for accommodating the female terminals (terminals) 50 to which the cables 51 are connected; an outer jacket portion 22 which is protruded and formed integrally outside the center of the housing main body 21 and into which the hood portion 12 of the male housing 11 is fitted, and a quadrangular cylindrical body portion 23 integrally formed at the rear portion of the housing main body 21.

Boss holes 24 that rotatably support lever bosses 34 of the lever 30 are formed in the center of the cylindrical body portion 23 side of both side surfaces 22*a*, 22*a* of the outer jacket portion 22 of the female housing 20, respectively. In addition, rectangular notches 25 are respectively formed at the front center of both side surfaces 22*a*, 22*a* of the outer jacket portion 22. On both sides of each rectangular notch 25, rib-shaped temporary locking portions 26 for temporarily locking a temporary locking lock portion 36 of the lever 30 are protruded and formed integrally. A concave lock storage portion (storage portion) 27 for storing the temporary locking lock portion 36 of the lever 30 in which the temporary locking state with each temporary locking portion 26 has been released is formed outside each of the temporary locking portions 26. Furthermore, a pair of assembling portions 28, 28 for assembling the cable cover 40 is formed on the rear end sides of both side surfaces of the cylindrical body portion 23 of the female housing 20, respectively. Each assembling portion 28 has a pair of projecting piece portions 28*a*, 28*a* integrally formed on the rear end sides of both side surfaces of the cylindrical body portion 23, and a pair of upstanding piece portions 28*b*, 28*b*. These assembling portions 28 are provided at positions where the lever bosses 34 do not interfere with the cable cover 40 when the lever bosses 34 are fitted into the boss holes 24.

As illustrated in FIG. 4, the lever 30 includes an operating portion 31, and a pair of arm portions 32, 32 extending from both sides of the operating portion 31 and arranged on both side surfaces of the female housing 20. The operating portion 31 has a width larger than the width of the cable cover 40, and the pair of arm portions 32, 32 extends outward of the cable cover 40.

As illustrated in FIG. 4, at the center of the operating portion 31 of the lever 30, a lever lock portion 33 for holding the lever 30 in the rotation restricted state when the rotation of the lever 30 is completed (when both male and female housings 11, 20 are fitted) is provided. The lever lock portion 33 is provided below the operating portion 31 (on the side of the cable cover 40). Then, the lever lock portion 33 is locked to a cover lock portion 48 of the cable cover 40 described later at the connector fitting completed position (lever forward operation completed position) of the operating portion 31 of the lever 30 as illustrated in FIG. 9.

In addition, each arm portion 32 of the lever 30 is provided with lever bosses 34 rotatably supported in the boss holes 24 formed on both side surfaces of the female housing 20 in a protruding condition as illustrated in FIG. 4. The interval between the lever bosses 34 formed on the respective arm portions 32 is larger than the outer shape of the cable cover. Furthermore, each arm portion 32 is formed with a cam groove 35 which is engaged with the cam boss 13 formed on the male housing 11. Then, the male and female housings 11, 20 are fitted with a low insertion force via the cam groove 35 and the cam boss 13 by the forward operation of the operating portion 31 of the lever 30. Note that the male and female housings 11, 20 are detached with a low insertion force by the backward operation of the operating portion 31 of the lever 30.

Furthermore, a temporary locking lock portion 36 is cut out at a position near the entrance 35*a* of the cam groove 35 of each arm portion 32 of the lever 30 as illustrated in FIG. 4. The temporary locking lock portion 36 has a lock arm 36*a* that is elastically deformed, and a locking projection 36*b* that is formed integrally with the lock arm 36*a* and that is temporarily locked to the rib-shaped temporary locking portion 26 of the female housing 20.

As illustrated in FIGS. 1 to 5, the cable cover 40 is a member for protecting the plurality of cables 51 pulled out from the cylindrical body portion 23 at the rear portion of the female housing 20 so that a mechanical load does not act on the cables 51. The cable cover 40 has a pair of side walls 41, 41 configuring openings, a curved ceiling wall 42 having a curved surface, and a housing abutting wall 43 that covers one end side on the narrow side of the pair of side walls 41, 41. The cable cover 40 is formed so as to be attached to an assembling portion 28 provided on the rear end side of the cylindrical body portion 23 of the female housing 20.

As illustrated in FIG. 2, a slide rib 44 is protruded and formed integrally at the lower end of the side wall 41 of the cable cover 40, and the slide rib 44 is slidably attached between a pair of projecting piece portions 28*a*, 28*a* and a pair of the upstanding piece portions 28*b*, 28*b* of the assembling portion 28 so as not to come off.

In addition, as illustrated in FIG. 2, after the lower end side of the side wall 41 of the cable cover 40 slides between the projecting piece portion 28*a* and the upstanding piece portion 28*b* of the assembling portion 28 of the cylindrical body portion 23 of the female housing 20, the lock projection 45*b* of the elastic lock piece 45 formed integrally at the lower end of the side wall 41 is engaged with a concave locked portion (not illustrated) formed in the cylindrical body portion 23 of the female housing 20. The elastic lock piece 45 has a long lock arm 45*a*, and a lock projection 45*b* protruded and formed integrally at the tip of the lock arm 45*a*.

In addition, as illustrated in FIGS. 1 to 5, a cable holding portion 47 for holding a plurality of cables 51 bundled and tape-wrapped is protruded and formed integrally in a U-shape at the tip side of the opening of the ceiling wall 42 of the cable cover 40. Furthermore, as illustrated in FIGS. 4 and 9, a cover lock portion 48 that is locked to the lever lock portion 33 of the lever 30 is provided on the rear side of the cable holding portion 47 of the ceiling wall 42. The cover lock portion 48 is arranged at the tip portion of a lock arm 48*a* that is formed integrally with the ceiling wall 42 to deform elastically.

Note that on both side surfaces of the female housing 20 as illustrated in FIGS. 2 to 4, a pair of a rib-shaped temporary locking portion 26 for temporarily locking the temporary locking lock portion 36 of the lever 30 so that the lever 30 can be attached from both the front side and the rear side of the cable cover 40, respectively, and a concave lock storage portion 27 for storing a locking projection 36*b* of the temporary locking lock portion 36 of the lever 30 in which the temporary locking state with each temporary locking portion 26 is released is formed on both left and right sides so as to sandwich the boss hole 24.

In addition, as illustrated in FIGS. 5 and 9, an elliptical flange-shaped hook piece portion 13*a* is provided in a protruding condition at an upper end of a columnar cam boss 13 provided on the male housing 11. Then, the hook piece portion 13*a* of the cam boss 13 moves by being hooked on a guide rib 35*b* provided in a protruding condition on one of the arc portions of the cam groove 35 of the lever 30, so that the cam boss 13 does not come off from the cam groove 35. Further, as illustrated in FIGS. 1 and 9, a pair of thin and arcuate engagement piece portions 32*a*, 32*a* is provided in a protruding condition on the tip side of the arm portion 32 of the lever 30. Then, when the temporary locking lock portion of the lever 30 is released, the hook piece portion 13*a* of the cam boss 13 of the male housing 11 is hooked to the guide rib 35*b* of the cam groove 35 of the lever 30, and a pair of engagement piece portions 32*a*, 32*a* of the lever 30 is engaged with a pair of locking piece portions 22*b*, 22*b* provided in a protruding condition in an L shape from both sides of the outer jacket portion 22 of the female housing 20. Thereby, the male housing 11 and the lever 30 are not disengaged from the female housing 20 side.

As described above, according to the lever-type connector 10 of the first embodiment, when the female connector B is assembled, first, a female terminal 50 to which a cable 51 is connected is inserted into a terminal accommodating chamber 21*a* of the housing main body 21 of the female housing 20 as illustrated in FIG. 2 (terminal inserting step). At this time, since the lever 30 is not assembled to the female housing 20, the workability of terminal insertion is good.

Next, as illustrated in FIG. 3, the cable cover 40 is assembled to the female housing 20 in which the female terminals 50 are inserted into the terminal accommodating chambers 21*a* (cover assembling step). At this time, since the lever 30 is not assembled to the female housing 20, the cover assembling workability is good.

Next, as illustrated in FIG. 4, the lever bosses 34 of the lever 30 are fitted into the boss holes 24 of the female housing 20, and the lever 30 is assembled on the female housing 20 (lever assembling step). Thus, by assembling the lever 30 to the female housing 20 last, the work of inserting the female terminal 50 and the ease of assembling the cover 40 can be improved, and the work efficiency can be improved. Then, the male connector A consisting of the female connector B in the assembled state illustrated in FIG. 1 and the male housing 11 illustrated in FIG. 5 or the like is shipped to a vehicle assembling factory or the like in a separated state without fitting.

In addition, as illustrated in FIG. 5, before the male housing 11 and the female housing 20 of the lever-type connector 10 are fitted, the locking projections 36*b* of the temporary locking lock portion 36 of the lever 30 are temporarily locked to the rib-shaped temporary locking portions 26 of the female housing 20 (FIG. 6). From this state, when the hood portion 12 of the male housing 11 is fitted between the housing main body 21 and the outer jacket portion 22 of the female housing 20, the locking projection 36*b* of the temporary locking lock portion 36 of the lever 30 abuts the tip 14*a* side of the lever temporary locking release rib 14 of the male housing 11 and the lock arm 36*a* of the temporary locking lock portion 36 bends outward as illustrated in FIG. 7. Thereby, the temporary locking state between the locking projections 36*b* of the temporary locking lock portion 36 of the lever 30 and the rib-shaped temporary locking portions 26 of the female housing 20 is released.

Then, when the hood portion 12 of the male housing 11 is further pushed into the depth between the housing main body 21 and the outer jacket portion 22 of the female housing 20 by the force of inertia, the locking projections 36*b* of the temporary locking lock portion 36 of the lever 30 fall into the lock storage portions 27 of the female housing 20 as illustrated in FIG. 8. Therefore, the lever 30 is in a state of not moving in the backward operation direction (the direction opposite to the forward operation direction). At this time, since the hook piece portion 13*a* of the cam boss 13 of the male housing 11 is hung on the guide rib 35*b* of the cam groove 35 of the lever 30 and does not come off from the cam groove 35, the cam groove 35 of the lever 30 does not fall out of the cam boss 13 of the male housing 11 and the cam boss 13 can be easily pulled into the cam groove 35.

Figure 10:
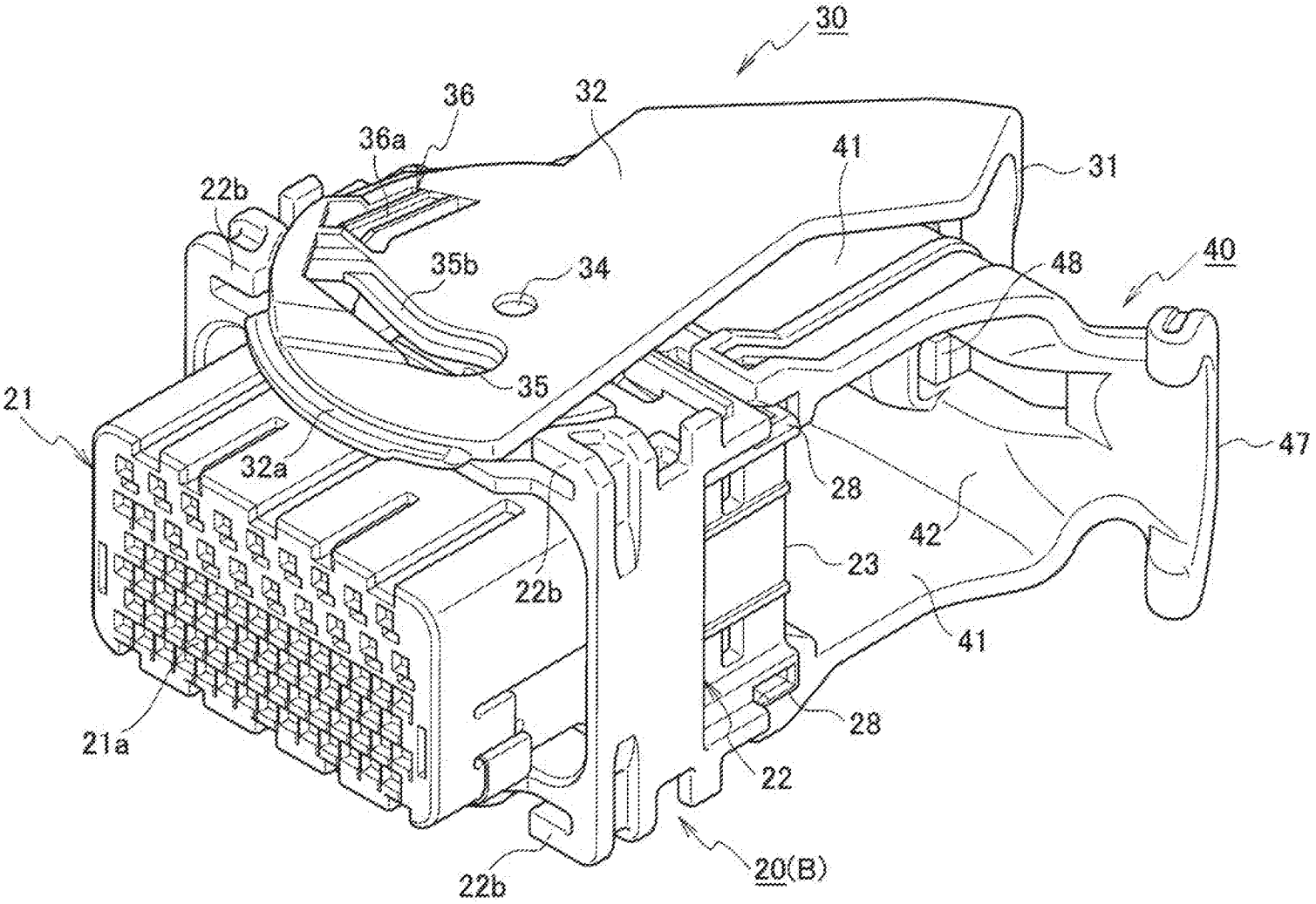
FIG. 10 is a perspective view illustrating a state where a cable cover and a lever are assembled to a female housing of a lever-type connector according to a second embodiment of the present disclosure.
Figure 11:
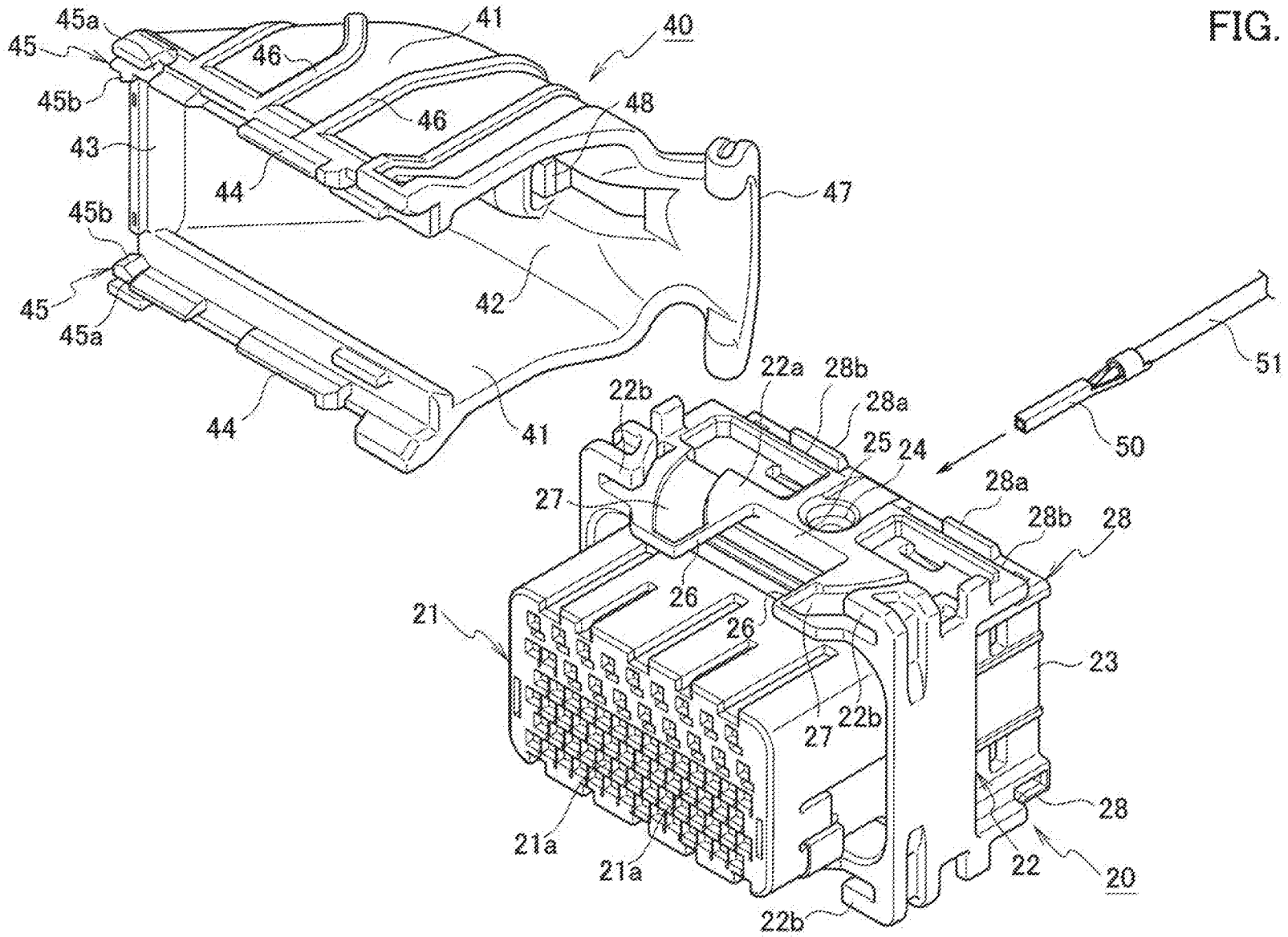
FIG. 11 is a perspective view illustrating a state before a cable cover is assembled to the female housing of the second embodiment.
Figure 12:
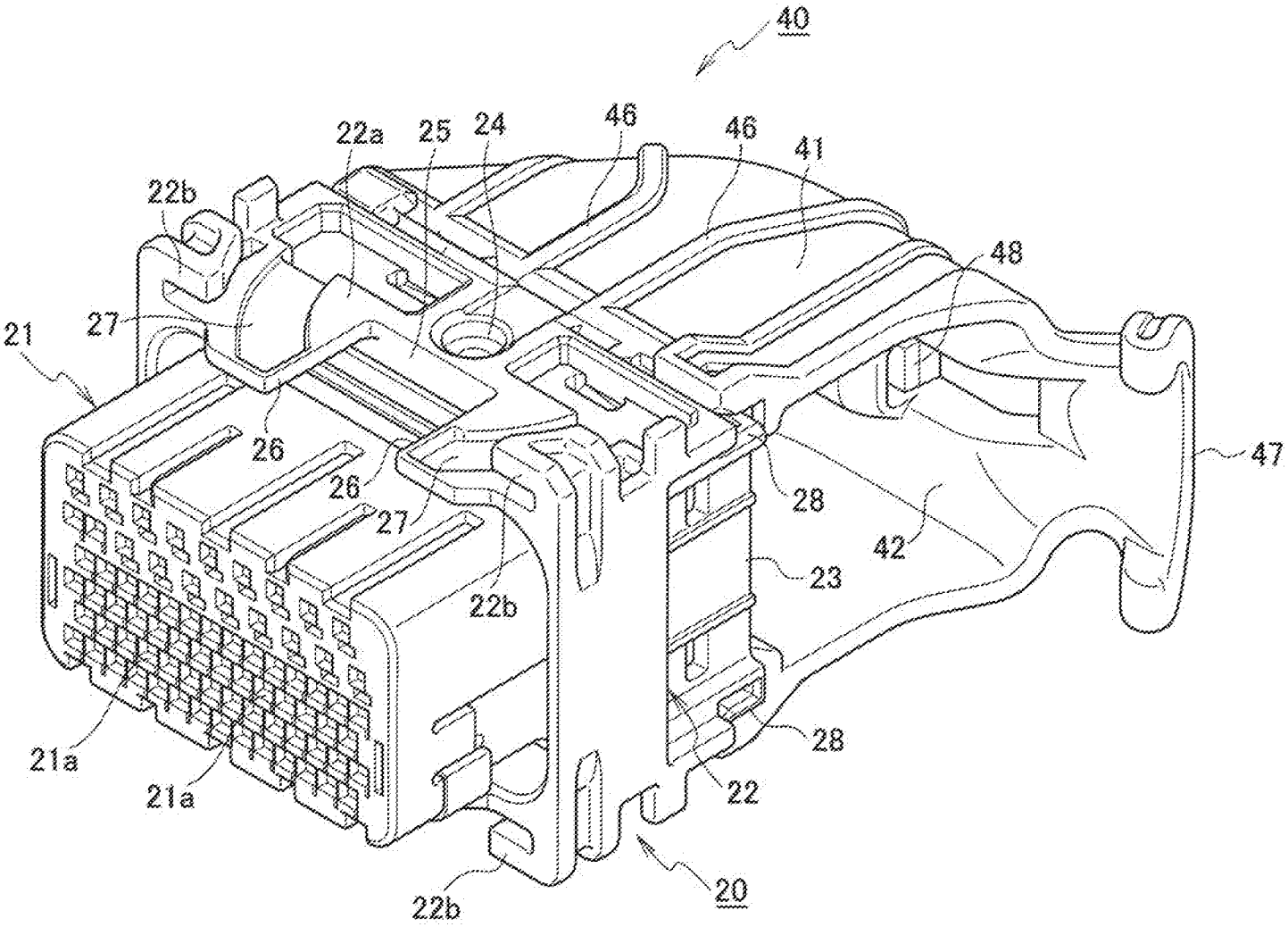
FIG. 12 is a perspective view illustrating a state where a cable cover is assembled to the female housing of the second embodiment.
Figure 13:
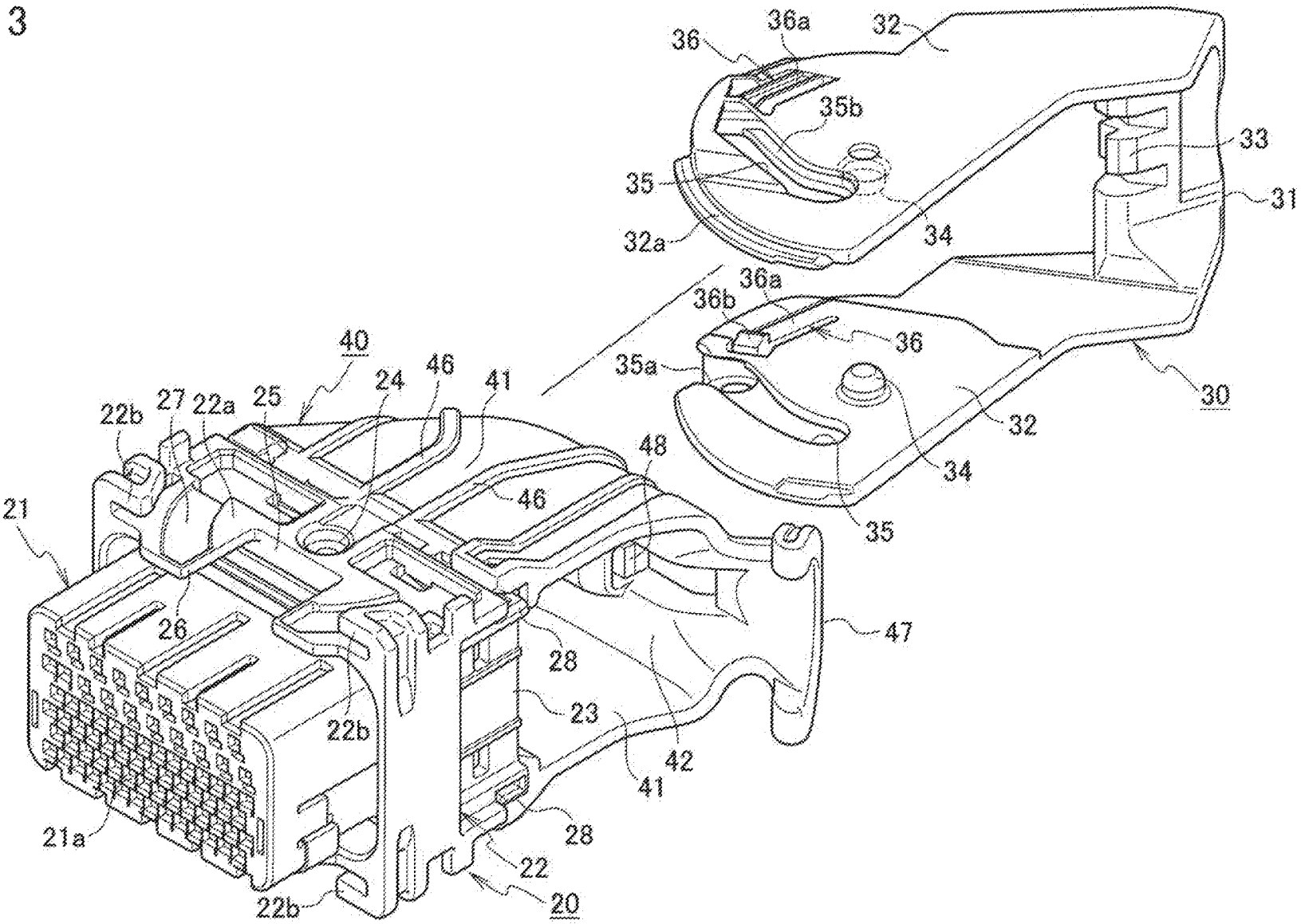
FIG. 13 is a perspective view illustrating a state before a lever is assembled to the female housing of the second embodiment.
Figure 14:
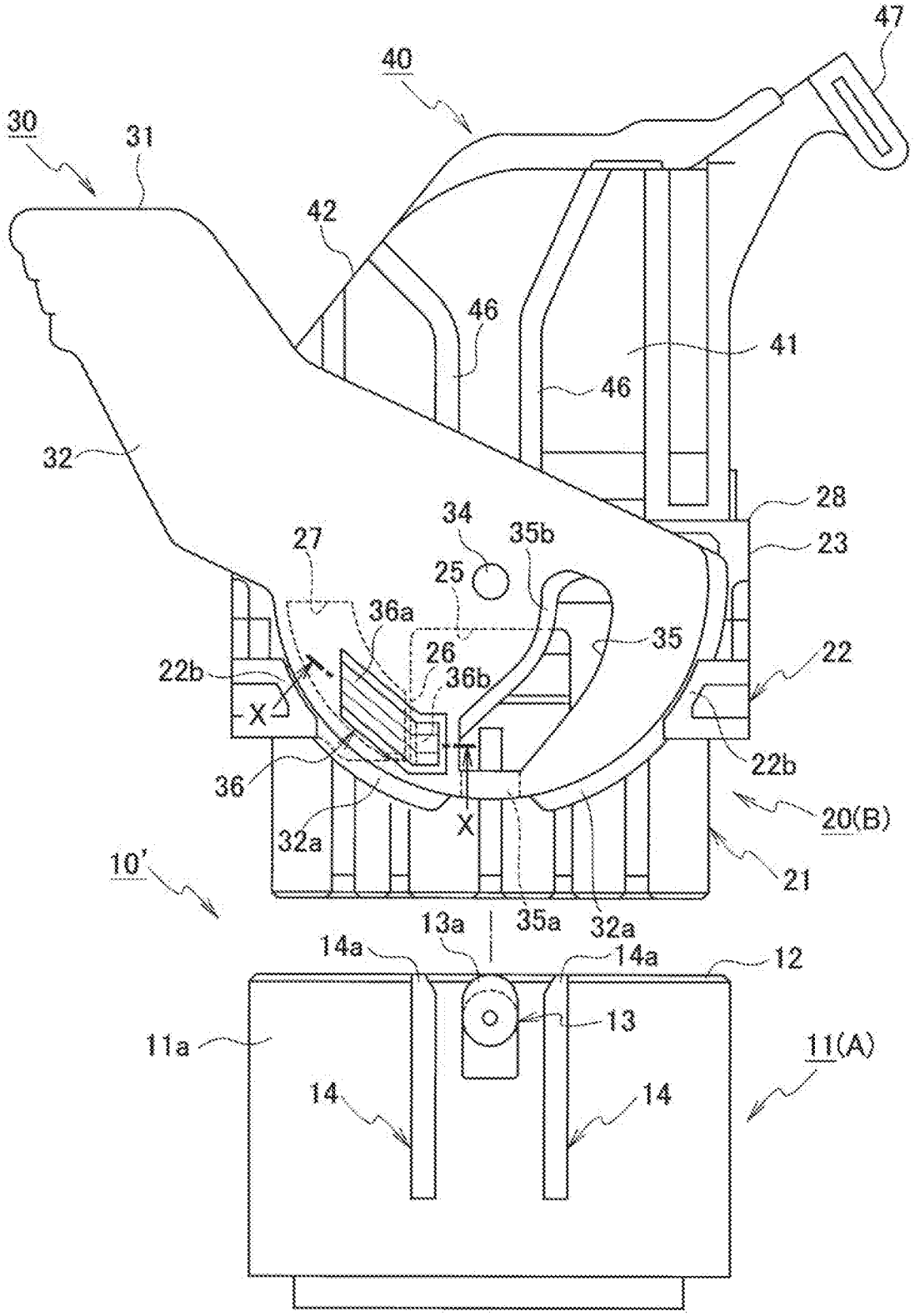
FIG. 14 is a side view illustrating a state before fitting of the lever-type connector of the second embodiment.
Figure 15:
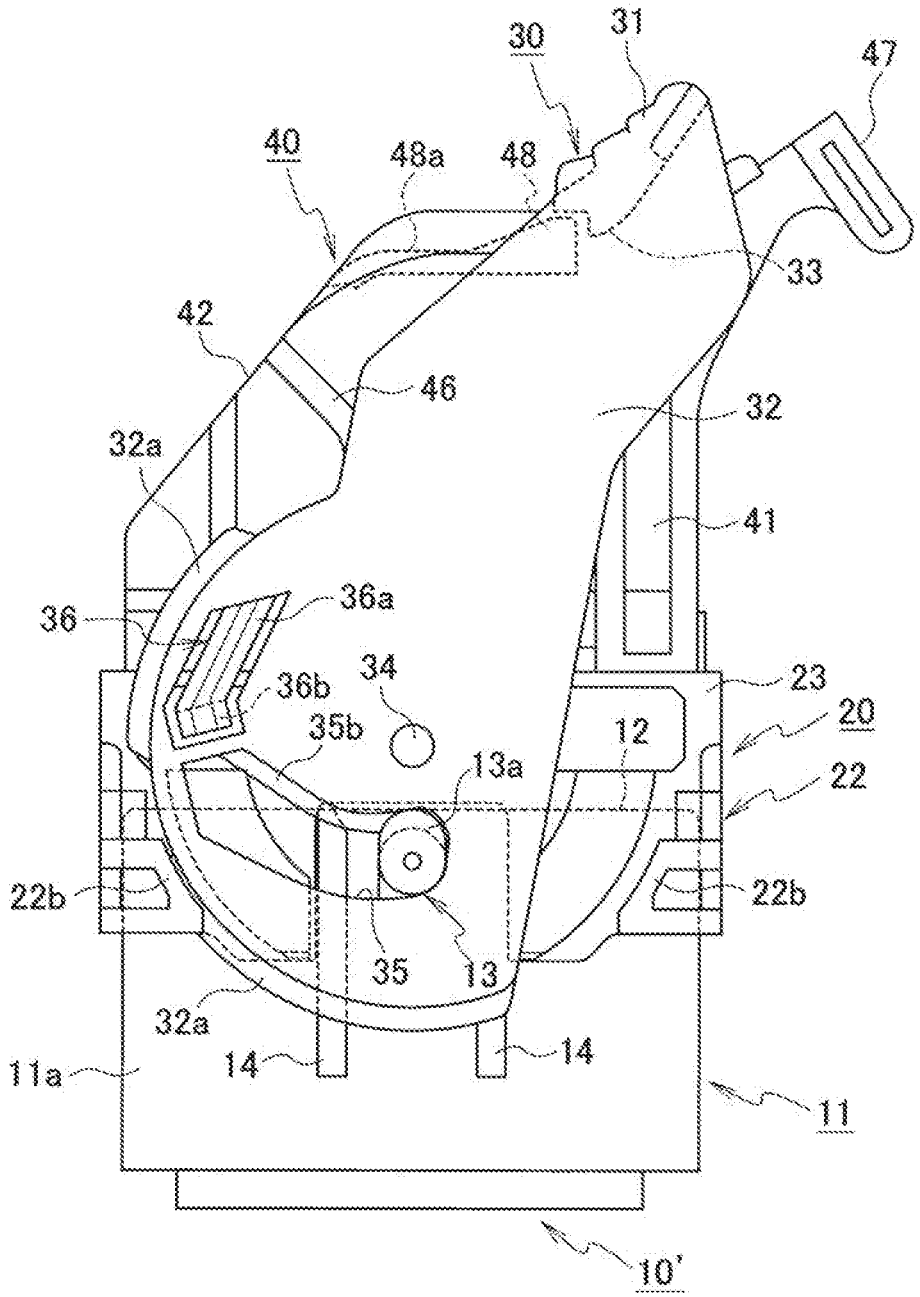
FIG. 15 is a side view illustrating a fitted state of the lever-type connector of the second embodiment.

FIG. 10 is a perspective view illustrating a state where a cable cover and a lever are assembled to a female housing of a lever-type connector according to a second embodiment of the present disclosure; FIG. 11 is a perspective view illustrating a state before a cable cover is assembled to the female housing; FIG. 12 is a perspective view illustrating a state where a cable cover is assembled to the female housing; FIG. 13 is a perspective view illustrating a state before a lever is assembled to the female housing; FIG. 14 is a side view illustrating a state before fitting of the lever-type connector; and FIG. 15 is a side view illustrating a fitted state of the lever-type connector.

The lever-type connector 10' of the second embodiment differs from that of the first embodiment in that a pair of guide ribs 46, 46 is formed on a side wall 41 of a cable cover 40. Note that since other features are the same as those of the first embodiment described above, the same components are denoted by the same reference numerals, and detailed description is omitted.

That is, a pair of guide ribs 46, 46 for guiding the lever bosses 34 of the lever 30 to the boss holes 24 of the female housing 20 are protruded and formed integrally on the side wall 41 of the cable cover 40 as illustrated in FIGS. 11 to 15. The pair of guide ribs 46, 46 is formed so as to gradually narrow and incline from the ceiling wall 42 side to the center, and extend in parallel from the center to the slide rib 44 side.

Then, in a lever assembling step of fitting the lever bosses 34 of the lever 30 into the boss holes 24 of the female housing 20 and assembling the lever 30 to the female housing 20, the lever bosses 34 of the lever 30 are guided between a pair of guide ribs 46, 46 provided on the side wall 41 of the cable cover 40, and the lever bosses 34 are guided into the boss holes 24 without hitting any protrusions or the like formed on the female housing 20. For this reason, the ease of assembling the lever 30 is improved, and as in the first embodiment, by assembling the lever 30 to the female housing 20 last, the work of inserting the female terminal 50 and the ease of assembling the cover 40 can be improved, and the work efficiency can be improved.

Note that the lever is attached to the female housing from the front side of the cable cover according to each embodiment described above, but the lever may be attached to the female housing from the rear side of the cable cover.

What is claimed is:

1. A lever-type connector assembly, comprising:

a first housing having a cam boss;

a second housing fitted to and detached from the first housing;

a lever that is removably attached to and rotatably supported by the second housing via a pair of lever bosses and has a cam groove engaged with the cam boss, wherein the lever pulls the first housing toward the second housing and fits the first housing to the second housing with an engagement between the cam groove and the cam boss by rotating an operating portion; and a cable cover removably attached to a rear portion of the second housing and protecting a plurality of cables drawn out from the rear portion of the second housing, wherein the second housing has an assembling portion for assembling the cable cover to the second housing, and boss holes rotatably supporting the lever bosses, the cover is assembled to the second housing prior to attachment of the lever thereto, and the cable cover has guide ribs for guiding the lever boss to the boss holes.

2. The lever-type connector assembly according to claim 1, wherein the assembling portion is provided at a position where the lever bosses and the cable cover do not interfere with each other when the lever bosses are fitted into the boss holes.

3. The lever-type connector assembly according to claim 1, wherein the lever has a pair of arm portions extending outward from the cable cover.

4. The lever-type connector assembly according to claim 3, the distance between the lever bosses formed on the pair of arm portions is larger than an outer shape of the cable cover.

5. A method of assembling a lever-type connector assembly, the lever-type connector assembly comprising:

a first housing having a cam boss;

a second housing that has terminal accommodating chambers in which a plurality of terminals to which cables are connected are accommodated and that is fitted to and detached from the first housing;

a lever that is rotatably supported to the second housing via lever bosses and has a cam groove engaged with the cam boss, wherein the lever pulls the first housing toward the second housing and fits the first housing to the second housing with an engagement between the cam groove and the cam boss by rotating an operating portion; and a cable cover attached to a rear portion of the second housing and protecting a plurality of the cables drawn out from the rear portion of the second housing, wherein the cable cover has guide ribs thereon and the second housing has boss holes for rotatably supporting the lever bosses, the method comprising following steps in stated order of:

a terminal inserting step of inserting terminals into the terminal accommodating chambers of the second housing;

a cover assembling step of assembling the cable cover to the second housing in which the terminals are inserted into the terminal accommodating chambers; and a lever assembling step of fitting the lever bosses into the boss holes of the second housing and assembling the lever to the second housing by guiding the lever bosses along the respective guide ribs into the boss holes.

* * * * *